United States Patent [19]

Fisher

[11] 4,236,537

[45] Dec. 2, 1980

[54] ORDERING SYSTEM FOR TOBACCO BULK CURING BARN

[75] Inventor: Gary H. Fisher, Rockingham, N.C.

[73] Assignee: Industrial Sheet Metal & Mechanical Corp., Rockingham, N.C.

[21] Appl. No.: 902,275

[22] Filed: May 3, 1978

[51] Int. Cl.[3] ..... A24B 3/02

[52] U.S. Cl. ..... 131/134; 131/140

[58] Field of Search ..... 131/134, 135, 136, 140 R; 261/106

[56] References Cited

U.S. PATENT DOCUMENTS

| | | | |
|---|---|---|---|
| 239,440 | 3/1881 | Burdick | 131/135 |
| 555,616 | 3/1896 | Peple | 131/134 |
| 556,916 | 3/1896 | Campbell | 131/134 |
| 568,491 | 9/1896 | Proctor | 261/24 |
| 588,530 | 8/1897 | Proctor | 98/30 |
| 1,339,373 | 5/1920 | Buensod | 131/140 R |
| 1,339,374 | 5/1920 | Buensod | 131/140 R |
| 3,359,989 | 12/1967 | Stocklocker | 131/136 |
| 3,738,621 | 6/1973 | Anderson | 261/106 X |
| 3,823,926 | 7/1974 | Bracich | 261/106 |
| 4,080,410 | 3/1978 | Goettl | 261/106 X |

*Primary Examiner*—Stephen C. Pellegrino

*Attorney, Agent, or Firm*—Bell, Seltzer, Park & Gibson

[57] ABSTRACT

An ordering device for use with a tobacco bulk curing barn of the type which comprises a housing having a tobacco curing chamber therein for receiving tobacco leaves for curing, means for directing air in a recirculating flow into and through the tobacco curing chamber, and a fresh air inlet for permitting air from outside the curing barn to be admitted into the recirculating flow of air at certain times during the curing operation for maintaining the desired curing conditions in the curing chamber. The ordering device comprises an air permeable pad positioned in the flow path of the outside air entering the curing barn with means for distributing water onto the air permeable pad and into contact with the air passing therethrough so as to humidify the outside air entering the curing barn.

2 Claims, 5 Drawing Figures

ORDERING SYSTEM FOR TOBACCO BULK CURING BARN

This invention relates to the curing of tobacco, and in particular, relates to an apparatus and method for use in association with a tobacco bulk curing barn for ordering the tobacco.

BACKGROUND OF THE INVENTION

Curing of tobacco by the "bulk curing" method involves placing a relatively compact mass of tobacco leaves within an enclosed curing barn and circulating heated air through the mass of tobacco to bring about curing and drying of the leaves. The curing cycle extends over several days, during which the tobacco is initially subjected to a controlled elevated temperature and relatively high humidity conditions to bring about a chemical change in the leaves resulting in yellowing of the leaf. Following yellowing, the temperature is increased and the humidity reduced to bring about setting of the color and drying of the leaves and stems.

When drying is completed, it is generally necessary to restore some of the moisture which was removed during the drying operation. This procedure, conventionally referred to as "ordering", is necessary in order to restore flexibility to the leaves to permit handling of the tobacco without crumbling. In the conventional barn curing procedures which have been practiced for many years, ordering was often accomplished by simply opening the doors to the barn and allowing the relatively humid outside air to contact the tobacco. Sometimes, the ordering was speeded up somewhat by wetting down the floor of the barn prior to removal of the tobacco from the barn.

These prior procedures for ordering tobacco have also been followed to some extent with bulk curing. However, as applied to bulk curing, these procedures are relatively slow and undesirably limit the utilization of the bulk curing barn. Additionally, these procedures provide no effective control over the amount of moisture restored to the tobacco. Ordering serves not only to restore flexibility to the leaves but serves also to restore weight. Since the tobacco is sold by weight, it is important in order to obtain the maximum price for the tobacco that the moisture content be within certain desired limits. Tobacco having a moisture content less than the optimum level will weigh less and will consequently bring a lower total price, while tobacco having a moisture content in excess of the desired limits is regarded as being of lower grade and will generally be sold at a reduced price per pound.

With the foregoing in mind, it is an important object of this invention to provide a practical and effective apparatus and method which is suitable for use with a tobacco bulk curing barn for ordering the tobacco.

It is another object of this invention to provide an apparatus and method for ordering tobacco in a bulk curing barn which permits increasing the humidity conditions within the curing chamber in a controlled manner as needed to bring about the desired moisture content in the tobacco.

It is another object of this invention to provide an apparatus and method of the type described which is useful not only for restoring a desired moisture content to the tobacco during ordering, but which may also be used for providing more effective control over the humidity conditions in the curing chamber during other portions of the curing cycle, such as during yellowing for example.

It is still another object of this invention to provide an apparatus and method of the type described which may be readily used in conjunction with a variety of different types of existing bulk curing barns, without requiring substantial modification thereto.

In accordance with this invention these and other objects are achieved by means of a relatively simple and reliable device which may be easily secured to a bulk curing barn and which is operable for increasing the moisture content of the tobacco in the curing chamber in a controlled manner. The apparatus of the present invention comprises an air permeable pad positioned in the flow path of the outside air which enters the housing of the tobacco curing barn and means associated therewith for distributing water onto the air permeable pad and into contact with the air passing therethrough so as to humidify the air upon entering the curing barn.

More particularly, the air permeable pad is mounted in a vertical orientation for the flow of air generally horizontally therethrough and means is provided for directing water onto the uppermost edge portion of the pad so that the water may flow by gravity downwardly through the pad and into contact with the air passing therethrough. The pad is mounted in a generally rectangular frame which surroundingly engages the perimeter of the pad and serves for mounting the ordering device in the proper position across the fresh air inlet of the curing barn.

The method of ordering bulk cured tobacco in accordance with this invention comprises the steps of drawing air from outside the curing barn into the barn and into and through a porous pad wetted with water to humidify the air upon entering the curing barn, and directing the thus humidified air into and through the curing chamber of the barn and into contact with the cured and dried tobacco positioned therein to thereby restore moisture to the tobacco and facilitate subsequent handling thereof.

The ordering device of this invention is also useful for preventing premature color setting of the tobacco during yellowing. This aspect of the present invention involves drawing air from outside the curing barn into the barn and into and through a porous pad wetted with water to humidify the air upon entering the curing barn, and then directing the thus humidified air into and through the curing chamber of the curing barn and into contact with the tobacco which is undergoing yellowing to prevent excessive drying and premature color setting of the tobacco during yellowing.

Some of the objects, features and advantages of the invention having been stated, others will appear as the description proceeds, when taken in connection with the accompanying drawings, in which FIG. 1 is a perspective view of a tobacco bulk curing barn provided with an ordering system in accordance with this invention;

Figure 1:
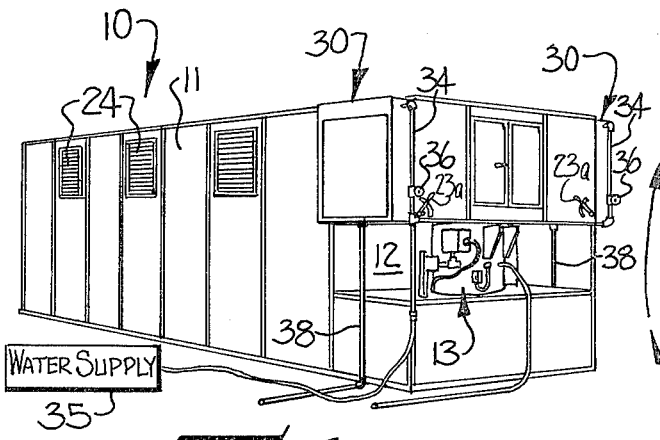

Referring now more particularly to the drawings, a tobacco bulk curing barn is illustrated in FIG. 1 and indicated generally by the reference character 10. The bulk curing barn 10 includes a generally rectangular housing 11 having a hollow interior, with a partition wall 12 located adjacent one end of the housing and defining a curing chamber within the hollow interior portion of the housing for receiving the tobacco to be cured.

The tobacco leaves, supported in a relatively compact mass by racks or in boxes as is conventional, are loaded into the curing chamber through doors provided in housing 11 at the opposite end of the barn from that illustrated in FIG. 1.

Figure 2:
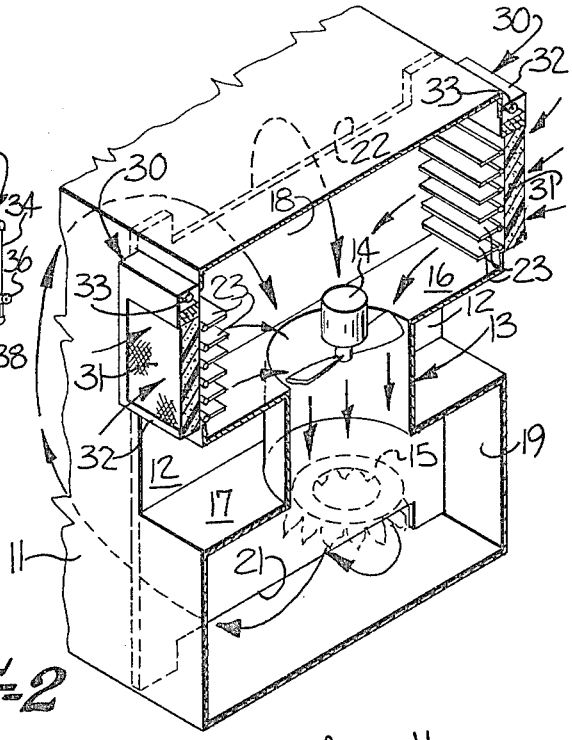
FIG. 2 is a sectional perspective view of the end portion of the tobacco bulk curing barn which houses the furnace and showing the ordering device and the flow of air in the barn.

A furnace 13 is provided at the end of the barn illustrated in FIG. 1 for directing heated air into the curing chamber and through the tobacco located therein. As best seen in FIG. 2, the furnace 13 includes a fan or blower 14 and a burner, schematically indicated at 15, which may be fired by a suitable fuel such as gas or oil.

As best seen in FIG. 2, horizontal walls 16 and 17 are provided adjacent the upper and lower portions of the furnace 13, respectively. These walls 16 and 17 cooperate with the partition wall 12 and with the housing 11 to define an upper plenum chamber 18 on the suction side of the furnace and a lower plenum chamber 19 on the discharge or output side of the furnace. An opening 21 provided in the lower portion of partition wall 12 provides communication between the lower plenum chamber 19 and the curing chamber for directing the heated air from the plenum chamber 19 into the curing chamber. An opening 22 provided in the upper portion of the partition wall 12 provides communication between the curing chamber and the upper plenum chamber 18 for recirculation of air from the curing chamber to the furnace 13.

Fresh air inlet openings are provided in opposite sides of the housing 11 communicating with the upper plenum chamber 18 and dampers 23 are mounted in these fresh air inlet openings to control the introduction of outside air through the fresh air inlet openings. Damper adjustment levers **23*a*, accessible from outside the barn, permit manual adjustment of positioning of the dampers 23 for controlling the amount of outside air being introduced into the curing chamber. Exhaust vents 24 are provided along both sides of housing 11 communicating with the curing chamber. These exhaust vents 24 are normally closed, but permit air to be displaced from the curing chamber when the fresh air dampers 23** are opened to allow fresh air to be introduced into the barn.

Typically, when curing tobacco in a bulk curing barn of this type, the dampers 23 will be closed or only partially open during the initial or yellowing stage of curing so that little or no fresh air is introduced into the barn and the relative humidity is maintained at a relatively high level. During this time the temperature in the barn is maintained at about 100 degrees F. After sufficient yellowing has taken place, the temperature in the barn is advanced gradually and the fresh air dampers 23 are opened to permit the introduction of fresh air, reducing the relative humidity in the curing chamber and promoting drying. After the majority of the moisture has been removed from the leaf portion of the tobacco, the dampers may be moved to a more closed position to conserve fuel while drying the more difficult to dry stem portions of the tobacco leaves.

After the stems of the leaves have been sufficiently dried, the curing operation is essentially completed. However, before the tobacco leaves can be removed from the barn, it is necessary to restore some of the removed moisture to the leaves in order to permit handling the leaves. As noted earlier, this operation, referred to as "ordering", is often carried out by merely opening the doors to the barn and allowing the ambient moisture to contact the tobacco. Another conventional procedure is to open the fresh air dampers of the barn and allow the fan to operate with the burner inactive to direct a forced flow of outside air through the tobacco.

The ordering system of the present invention provides a positive and readily controllable means to increase the humidity of the air in the curing chamber so as to restore moisture to the leaves.

An ordering unit is provided which may be readily attached to an existing bulk curing barn without requiring any substantial modification thereto. The ordering unit is indicated generally in the drawings by the reference character 30.

The particular location for mounting the ordering unit is not critical. It is, however, important that the unit be positioned in the flow path of the outside air entering the curing chamber.

In the curing barn illustrated in the drawings, two ordering units 30 are provided and they are mounted to the housing 11 so as to overlie the fresh air inlet openings.

In a number of commercially available bulk curing barns, the fresh air inlet opening and associated control damper is provided directly on the furnace unit rather than on the barn housing as in the construction illustrated herein. With such curing barns, the ordering unit 30 may be mounted at any suitable location which would insure that the entering fresh air would pass therethrough. For example, the ordering unit may be mounted directly on the louvered furnace enclosure doors which provide access to the furnace unit.

Figure 3:
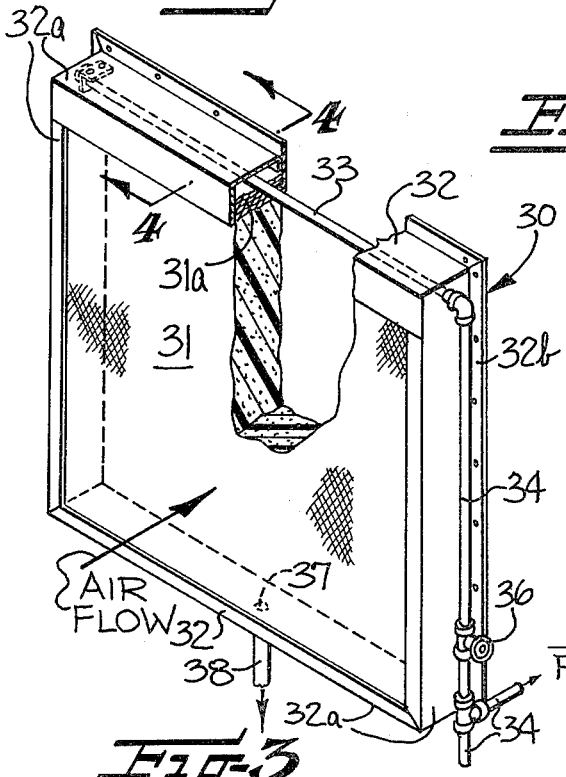
FIG. 3 is a perspective view of an enlarged scale showing the ordering device of this invention, with portions thereof broken away for clarity of illustration.
Figure 4:
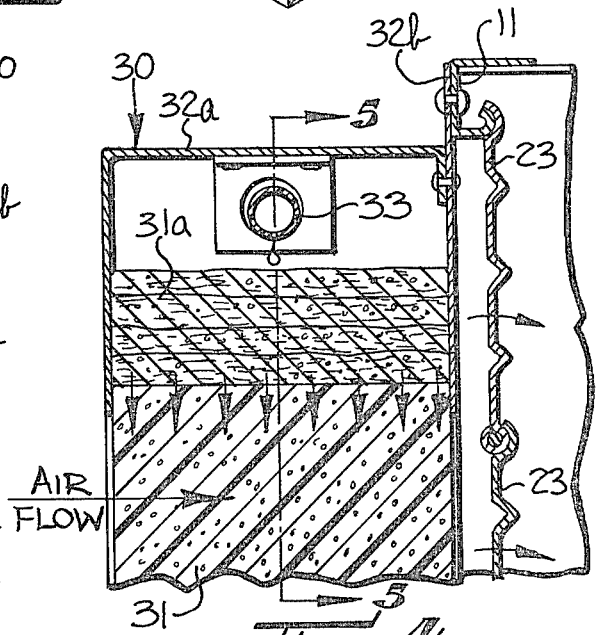
FIG. 4 is a sectional view of the ordering device taken substantially along the line 4—4 of FIG. 3.
Figure 5:
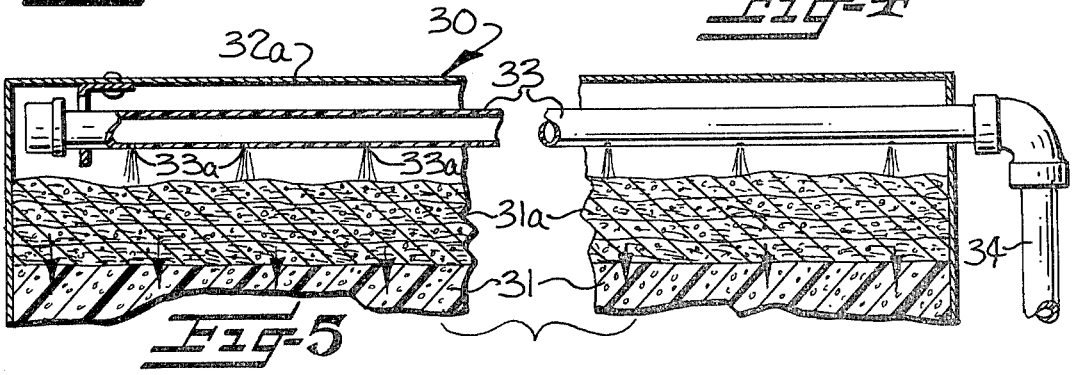
FIG. 5 is a sectional view through the upper portion of the ordering device taken substantially along the line 5—5 of FIG. 4.

Referring to FIGS. 3 and 4, the ordering unit 30 is mounted in a vertical orientation and includes a liquid gas contact media in the form of an air permeable pad 31 adapted for the flow of air generally horizontally therethrough, with a frame 32 surrounding and supporting the pad in position. The pad is adapted to be wetted by a stream of water trickling downwardly therethrough and provides a very large surface area for the water to contact the air passing through the pad. There are a variety of kinds of media which may be suitably employed as the pad material in the ordering unit of this invention. The preferred type of media is an expanded cellulosic pad material formed from a plurality of layers of expanded apertured cellulosic sheets assembled so as to provide a large number of transverse air passageways therethrough. One suitable such pad material is sold under the mark Cel-dek available from Munters, Inc. in Fort Myers, Fla.

The frame 32 is formed of generally U-shaped cross section members **32*a* assembled in a generally rectangular relationship extending along the respective sides of the pad. A mounting flange 32*b* is provided along one side of the U-shaped members 32*a* to facilitate securing the ordering unit to a mounting surface, such as the barn housing 11** and means is provided along the upper portion of the frame defining a water distribution channel for distributing water onto the uppermost edge portion of the pad.

More particularly, it will be noted that a conduit 33 extends longitudinally along the uppermost frame member 32*a* overlying substantially the entire length of the pad 31. A series of holes 33*a* provided in the underside of the conduit direct streams of water downwardly onto the uppermost edge portion of the pad. As illustrated, the pad includes a relatively thin distribution mat 31*a* positioned along the uppermost edge thereof and underlying the conduit for providing more effective distribution of water throughout the entire thickness of the pad.

Piping 34 provided along the exterior of the barn (FIG. 1) directs water from a suitable supply source 35 to each of the ordering units 30. Valves 36 are provided in the piping for controlling the flow of water to the ordering units. Referring to FIG. 3, it will be noted that the lowermost frame member 37*a* which underlies the lowermost edge portion of the pad serves as a trough for receiving any excess water which may pass from the pad. A drain opening 37 is provided in the frame member to which a drain conduit 38 is connected for directing the excess water away from the curing barn.

Under normal curing conditions, the valves 36 will be closed during the yellowing and drying stages of the curing operation so that no water will be directed to the ordering units. When drying is completed and the operator is ready to begin ordering the tobacco, the valves 36 will be opened to supply water to the pad. At this time, the fresh air dampers 23 will be opened fully if they are not already in that position. The fan 14 will be activated and the burner 15 turned off. This will result in the fan drawing outside air through the ordering units and into the recirculating flow of air through the barn. The air, upon passing through the ordering units, will come into contact with the water, resulting in the relative humidity thereof being increased considerably.

In order to minimize the time required for ordering, and to thereby obtain maximum utilization of the curing barn, it is desirable during ordering to humidify the air being introduced into the barn to a relatively high degree of saturation. Acceptable results have been observed with an air saturation as high as 88% relative humidity. For optimum saturation efficiency at practical air flow rates, it has been determined that the surface area of the porous pads of the ordering units should preferably be coordinated with the rated fan capacity so as to provide an air velocity through the pads within the range of about 250 to 700 feet per minute.

Under some circumstances the ordering units may be effectively utilized during the yellowing operation to prevent excessive drying of the tobacco and premature setting of the color before the desired amount of yellowing has taken place. Conditions conducive to excessive drying may occur, for example, when the temperature falls considerably at night time and the furnace operates for extended periods of time in attempting to maintain a predetermined temperature level called for by the thermostat.

The ordering units of the present invention can be effectively utilized in such situations to provide increased humidity in the curing chamber during yellowing so as to prevent overdrying of the tobacco and premature setting of the color.

In the drawings and specification, there has been set forth a preferred embodiment of the invention, and although specific terms are employed, they are used in a generic and descriptive sense only and not for purposes of limitation.

That which is claimed is:

1. In a method for bulk curing tobacco wherein the tobacco is supported in a relatively compact mass within the curing chamber of a bulk curing barn, said method comprising the steps of directing air in a recirculating flow repeatedly passing into and through the curing chamber and into contact with the compact mass of tobacco positioned therein while controllably heating the air to cure and dry the tobacco located in the curing chamber, the combination therewith of a method for quickly and controllably restoring moisture to the cured and dried tobacco prior to removal of the tobacco from the curing chamber to thus facilitate subsequent handling of the tobacco, said method comprising the steps, performed upon the completion of the curing and drying of the tobacco in the curing chamber, of continuing to direct air in a recirculating flow repeatedly passing into and through the curing chamber of the curing barn and into contact with the compact mass of cured and dried tobacco positioned therein while also drawing air from outside the curing barn into the barn and through a porous pad wetted with water to humidify the air on entering the curing barn, and directing the thus humidified outside air into the recirculating flow of air through the curing chamber to thus quickly and controllably increase the humidity level within the curing chamber and thereby restore moisture to the tobacco and facilitate subsequent handling thereof.

2. A method according to claim 1 wherein the air is drawn through the porous pad at a velocity within the range of 250 to 700 feet per minute.

* * * * *